US011885048B2

(12) United States Patent
Konukoglu et al.

(10) Patent No.: US 11,885,048 B2
(45) Date of Patent: Jan. 30, 2024

(54) RINGSPINNING SYSTEM FOR PRODUCING A YARN AND METHOD FOR STOPPING THE SUPPLY OF FILAMENTS TO A DRAFTING STAGE OF A RINGSPINNING SYSTEM

(71) Applicant: SANKO TEKSTIL ISLETMELERI SANAYI VE TICARET ANONIM SIRKETI, Gaziantep (TR)

(72) Inventors: Hakan Konukoglu, Gaziantep (TR); Gokhan Aydin, Gaziantep (TR)

(73) Assignee: SANKO TEKSTIL ISLETMELERI SANAYI VE TICARET ANONIM SIRKETI, Gaziantep (TR)

( * ) Notice: Subject to any disclaimer, the term of this patent is extended or adjusted under 35 U.S.C. 154(b) by 60 days.

(21) Appl. No.: 17/596,326

(22) PCT Filed: Feb. 6, 2020

(86) PCT No.: PCT/EP2020/052943
§ 371 (c)(1),
(2) Date: Dec. 7, 2021

(87) PCT Pub. No.: WO2020/244813
PCT Pub. Date: Dec. 10, 2020

(65) Prior Publication Data

US 2022/0228299 A1 Jul. 21, 2022

(30) Foreign Application Priority Data

Jun. 7, 2019 (EP) ..... 19179150

(51) Int. Cl.
*D02G 3/32* (2006.01)
*D01H 1/02* (2006.01)
(Continued)

(52) U.S. Cl.
CPC ..... *D02G 3/324* (2013.01); *D01H 1/02* (2013.01); *D01H 3/04* (2013.01); *D01H 13/16* (2013.01); *D01H 9/187* (2013.01)

(58) Field of Classification Search
CPC ..... D01H 1/02; D01H 9/187; D01H 13/14; D01H 13/181; D01H 13/18;
(Continued)

(56) References Cited

U.S. PATENT DOCUMENTS 4,311,916 A * 1/1982 Schenkel ..... D01H 13/145 250/559.43
4,375,149 A * 3/1983 Hartmannsgruber ..... D01H 13/1616 57/264

(Continued)

FOREIGN PATENT DOCUMENTS

DE 19642222 A1 4/1998
EP 0016940 A1 10/1980

(Continued)

OTHER PUBLICATIONS

European Patent Office, Extended European Search Report Issued in Application No. 19179150.8, dated Dec. 18, 2019, Germany, 7 pages.

(Continued)

*Primary Examiner* — Patrick J. Lynch
(74) *Attorney, Agent, or Firm* — McCoy Russell LLP

(57) ABSTRACT

The present disclosure provides a ringspinning system for producing a yarn. It is provided a the ringspinning system comprising a bobbin holder for holding a bobbin from which a first filament is supplied, a drafting stage for drafting the first filament together with a second filament, which is fed
(Continued)

to the drafting stage, and a spindle, the ringspinning system further contains at least one sensor for detecting a breakage of the first and/or second filament and/or a roving comprising the first and second filament, which roving comes out of the drafting stage, and a clamp assembly comprising a clamp for fixing the second filament in the case that the sensor detects the breakage, wherein the clamp is provided adjacent the bobbin holder. It is further provided a method for stopping the supply of filaments to a drafting stage of a ring spinning system.

19 Claims, 5 Drawing Sheets

(51) Int. Cl.

| | |
|---|---|
| ***D01H 13/16*** | (2006.01) |
| ***D01H 13/04*** | (2006.01) |
| ***D01H 9/18*** | (2006.01) |
| ***D01H 3/04*** | (2006.01) |

(58) Field of Classification Search
CPC ..... D01H 13/1608; D01H 13/1658; D01H 13/188; D02G 3/324; D01G 31/00
See application file for complete search history.

(56) References Cited

U.S. PATENT DOCUMENTS

| | | | | |
|---|---|---|---|---|
| 4,501,114 | A * | 2/1985 | von Ronai-Horvath | D01H 13/165 57/86 |
| 4,656,822 | A * | 4/1987 | Meissner | D01H 13/188 57/264 |
| 5,701,729 | A | 12/1997 | Rees et al. | |
| 2006/0191253 | A1 | 8/2006 | Baba et al. | |
| 2009/0007538 | A1 * | 1/2009 | Cheng | D01H 1/00 57/282 |
| 2018/0216257 | A1 * | 8/2018 | Xia | D02G 3/047 |

FOREIGN PATENT DOCUMENTS

| | | | | |
|---|---|---|---|---|
| EP | 2145034 | B1 | 11/2016 | |
| GB | 832265 | A * | 4/1960 | D01H 13/1658 |
| JP | H09105027 | A | 4/1997 | |
| JP | 2006328554 | A | 12/2006 | |

OTHER PUBLICATIONS

ISA European Patent Office, International Search Report Issued in Application No. PCT/EP2020/052943, dated May 8, 2020, WIPO, 2 pages.
Japanese Patent Office, Office Action Issued in Application No. 2021-572467, dated Dec. 6, 2022, 9 pages.

* cited by examiner

RINGSPINNING SYSTEM FOR PRODUCING A YARN AND METHOD FOR STOPPING THE SUPPLY OF FILAMENTS TO A DRAFTING STAGE OF A RINGSPINNING SYSTEM

CROSS REFERENCE TO RELATED APPLICATIONS

The present application is a U.S. National Phase of International Application No. PCT/EP2020/052943 entitled "RINGSPINNING SYSTEM FOR PRODUCING A YARN AND METHOD FOR STOPPING THE SUPPLY OF FILAMENTS TO A DRAFTING STAGE OF A RINGSPINNING SYSTEM," and filed on Feb. 6, 2020. International Application No. PCT/EP2020/052943 claims priority to European Patent Application No. 19179150.8 filed on Jun. 7, 2019. The entire contents of each of the above-listed applications are hereby incorporated by reference for all purposes.

TECHNICAL FIELD

The present disclosure relates to a ringspinning system for producing yarns.

BACKGROUND AND SUMMARY

A known ringspinning system is for example described in EP 0 016 940 A1. Said document discloses a ringspinning system having a spindle, a drafting stage, and a bobbin holder. A bobbin on which a filament is wound up is mounted on the bobbin holder. The filament is guided through the drafting stage and is ring spun on the spindle. In said system, a sensor detects when during the spinning, the roving which comes out of the drafting stage is broken. A ring having a conical hole is provided upstream of the drafting stage. A pivotable lever having a plunger which fits into the hole is assigned to this ring. When the sensor detects the breakage of the roving downstream of the drafting stage, the lever is actuated and the plunger is fitted into the hole, whereby the filament supplied to the drafting stage is fixed. The end of the roving coming out of the drafting stage is sucked into a suction tube at the outlet of the drafting stage. The system disclosed in EP 0 016 940 is a ringspinning system for a single core yarn.

Further, dual or multiple core yarn ringspinning systems are known.

For example EP 2 145 034 B1 discloses a ringspinning system, wherein in a ringspinning section, a first and second filament is ring spun together to provide a dual core yarn. Said document discloses a situation where the first filament is an elastic filament and the second filament is a non-elastic filament.

This dual core yarn in accordance with EP 2 145 034 B1 further has a cover layer made of staple fibers. A roving of staple fibers is supplied together with the first and second filament and is ring spun in a ringspinning section.

Generally, the production speed of such ringspinning systems is very high. Sometimes it happens that the filaments upstream of the drafting stage or the roving downstream of the drafting stage break. This can cause trouble.

On the one hand, the broken end of the filaments on the downstream side of the breakage can freely move and can come into contact with the ring or the spindle of a ring spinning system, whereby said elements may be damaged.

On the other hand, it is also often a problem to reconnect the broken ends of the filaments to start the ringspinning again.

In view of this, it is an object of the present disclosure to provide a ringspinning system, wherein upon detection of a breakage of the first and/or second filament and/or the roving which comes out of the drafting stage, the problem of damaging the system is reduced while a reconnection of the broken filaments is facilitated.

In order to solve said problem, it is provided a ringspinning system.

The inventive ringspinning system is characterized by a clamp assembly comprising a clamp for fixing the second filament in the case that the sensor detects the breakage. This clamp is provided adjacent to the bobbin holder.

The ringspinning system is in particular a ringspinning system for a dual or multiple core yarn. Therefore, there may be provided a first and second filament which are fed to the drafting stage. When a sensor detects at least the breakage of one of the first and second filaments which are fed to the drafting stage and/or the roving which come out of the drafting stage, the clamp is actuated such that the second filament is fixed. This clamp is mounted near the bobbin holder, on which a bobbin for the first filament is held. As the second filament is fixed in the vicinity where the first filament which is fed to the drafting stage comes from the bobbin, in the case of breakage, both filaments can easily be gripped to be reconnected with the yarn on the spindle.

In particular, the clamp assembly may comprise a mounting plate which is placed adjacent to the bobbin. The mounting plate can be arranged perpendicular to a rotation axis of the bobbin. The clamp assembly further comprises a first and second clamp arm which are rotatable with respect to each other about an axis. Each of the first and second clamp arm having a fixing surface between which the second filament is fixed when the clamp is actuated.

The clamp arms may be held under tension by a spring such that the fixing surfaces are pressed against each other. The fixing surfaces may have a barbed configuration. When the second filament is pulled by the spindle and/or the drafting stage, it is possible that the second filament freely runs between the first and second fixing surfaces. When for example during breakage, the pulling force to the second filament is reduced or completely omitted, the end of the second filament is fixedly held between the fixing surfaces. It is also possible that the fixing surfaces are in a first state out of contact, and are actuated by an electrically driven actuator into contact to fix the end of the second filament. The mounting plate may have a generally planar shape. The mounting plate has a configuration that it extends perpendicularly to the bobbin axis. The mounting plate is adapted for mounting the clamp arms to the system.

The respective first and second clamp arms protrude from the mounting plate and basically extend within the plane of the mounting plate. Due to said configuration, there can be provided one assembly which ensures the fixing of the second filament, while bringing the fixation location of the second filament with clamp into the vicinity of the bobbin.

It may be the case that the first clamp arm and the second clamp arm are rotatably mounted on the mounting plate. As both clamp arms are rotatably mounted to the mounting plate, an exchange of the different elements is facilitated. Alternatively, the first clamp arm may be rotatably mounted on the mounting plate and the second clamp arm may be a unitary part with the mounting plate. When the second clamp arm is a unitary part with the mounting plate, the clamp assembly can be easily manufactured. The rotation axis of the first and second clamp arms may be offset from the rotation axis of the bobbin.

The mounting plate and/or the second clamp arm and/or the first clamp arm may be made of any material such as a plastic material, for example by injection molding. Also, a metallic material may be used.

According to a further development, the mounting plate has an anchoring hole with which the clamp assembly is anchored on an anchoring rod provided in the ringspinning system. The ringspinning system commonly has different anchoring points. As an anchoring point, a rod may be used which extends in a longitudinal direction through the complete system, such that adjacent lines of the system use the same anchoring rod. Namely, a ringspinning system may have several ringspinning lines, wherein always a bobbin holder, a drafting stage, and a spindle define one ringspinning line. The anchoring rod extends, for example, horizontally through different ringspinning lines and provides a fixation of the mounting plate and, thereby, the clamp assembly. Namely, the anchoring rod is fed through the anchoring hole. As long as a plurality of ringspinning lines is provided, each or several adjacent ringspinning lines can have the same configuration. Therefore, in a second ringspinning line, adjacent to a first ringspinning line, there may also be provided the respective inventive clamp assembly and/or at least one sensor for detecting a breakage. With the configuration of the anchoring hole which interacts with the anchoring rod, a simple mounting of the clamp assembly in the region of the bobbin holder is provided.

It may be beneficial that the anchoring rod is arranged offset and parallel to the rotation axis of the bobbin. For example, the rotation axis of the bobbin extends in an approximately horizontal direction of the system such that the bobbin axes of bobbins in different lines have one common rotation axis, which extends transverse to the different ringspinning lines.

The complete clamp assembly can also be rotated about the anchoring rod. If the clamp assembly is rotatably mounted to the anchoring rod, the mounting plate provides a separation of adjacent bobbins in different ringspinning lines. In this case, the bobbins are not fixedly mounted on these mounting plates, but just separately via these plates from each other.

According to a further embodiment, the mounting plate can have an erected portion, on which a knife element is mounted. The knife element is configured to cut the first filament at a point in the region of the bobbin where it is delivered from the bobbin to the drafting stage.

The erected portion may be a unitary part with the mounting plate and extends offset and parallel to the rotation axis of the bobbin.

When the at least one sensor detects a breakage, the knife element is configured to cut the first filament. This may be done as follows. The mounting plate is actuated e.g. by an actuator such that it is rotated about the anchoring rod, whereby the knife element is moved in a radial direction with respect to the anchoring rod. Thereby, the knife element contacts the first filament coming from the bobbin and cuts said first filament. Simultaneously, the clamp element which is also mounted on the mounting plate fixes the second filament. This fixation may be done in accordance with the aforementioned description and e.g. with the help of an electromechanical actuator.

If alternatively the mounting plate is fixedly and non-rotatably mounted to the anchoring rod, the cutting of the first element with the knife element may be done automatically due to the following. If a breakage occurs, the pulling force of the first and/or second filaments is reduced or completely omitted. Thereby, the travelling direction of the first filament from the bobbin to the drafting stage changes. The change in the travelling direction of the first filament may cause the first filament to come into contact with the knife element such that the knife element cuts the first element.

Such a configuration that the first filament is cut by the knife element is in particular preferred when the first filament is an elastic filament.

In this case, a breakage usually occurs in the second filament, which is inelastic filament.

As the first filament is difficult to break, it is cut. Therefore, the free end of the first filament and the free end of the second filaments can each be easily reconnected to the downstream end provided at the region of the spindle.

Therefore, there is provided the respective erected portion having the knife element. This knife element may be a blade having a cutting edge similar to a razor blade. This blade may be molded with the erected portion or there may be provided a removable connection between the blade and the erected portion.

In some embodiments, the erected portion is arranged perpendicularly to the first and second clamp arm. For instance, the erected portion can be a unitary part of the mounting plate.

The mounting plate may further have a nose portion protruding therefrom, which nose portion is perpendicularly arranged to the erected portion and perpendicularly arranged to the first and second clamp portions. This nose portion protrudes to a front side of the system in the configuration wherein the bobbin is mounted, such that the main part of the mounting plate is arranged between adjacent bobbins of the different ringspinning lines. The front side of the system is the side when viewed against the travelling direction of the first and second filaments.

The clamp assembly as well as the erected portion having the knife element may be manually actuated by the nose portion. For example, after the yarn is cut and the first and second clamp arm fix the second filament, this nose portion can be gripped by an operator to rotate the mounting plate.

The ringspinning system may further comprise a first and second driving cylinder with which the bobbin is rotated. Generally, such a first and second driving cylinder extends in a transverse direction or horizontal direction of the ringspinning system such that the first and second driving cylinder simultaneously drives adjacent bobbins of different ringspinning lines. An outer surface of the respective bobbin is driven by the first and second driving cylinder, while the bobbin is mounted between the first and second driving cylinders. The bobbin may be mounted loosely between the first and second driving cylinder and sandwiched in the horizontal direction of the system by the respective mounting plates of the clamp assemblies of adjacent ringspinning lines. This first and second driving cylinders may thus also serve as bobbin holders. The anchoring rod, on which the mounting plate is mounted, may extend in the same direction as the first and second driving cylinders and may lie approximately in the same plane as the first and second driving cylinders.

It is beneficial that the erected portion, on which the knife element is mounted is provided between the first and second driving cylinders. The first and second clamp arms which protrude from the mounting plate are provided rearward of the first and second driving cylinders and can be between the first driving cylinder and the anchoring rod.

The at least one sensor is constituted by a first sensor with which a breakage of the first filament is detected and the second sensor with which the breakage of the second filament is detected. By the combination of two different sensors, which detect the respective breakage of the respective filament, the detection performance can be increased.

In some embodiments, the second sensor is provided downstream of the first sensor.

According to a further embodiment, the ringspinning system may further comprise a pair of driving cylinders which are constituted by a third and fourth driving cylinder. These third and fourth driving cylinders are configured to drive the second filament when it is fed over at least one of said driving cylinders of the pair of driving cylinders. The pair of driving cylinders which are constituted by a third and fourth driving cylinder are located downstream of these first and second driving cylinders.

For example, the second filament travels along a lower side of a circumferential surface of the third driving cylinder to a location where the circumferential surfaces of the third and fourth driving cylinder contact each other to an upper side of a circumferential surface of the fourth driving cylinder. This pair of driving cylinders for driving the second filament can be mounted upstream of the drafting stage and downstream of the first and second driving cylinders.

Generally, the definition first driving cylinder, second driving cylinder, third driving cylinder, and fourth driving cylinder is used because the first driving cylinder is the most upstream one of the respective cylinders and the fourth driving cylinder is the most downstream one of the four cylinders. There may be also provided more than the respective described four driving cylinders. Also, the third and fourth driving cylinder, similar to the first and second driving cylinder, extend in a horizontal direction of the system.

The first sensor can be provided between the second and third driving cylinder.

The second sensor is e.g. provided upstream of the drafting stage and downstream of the pair of cylinders constituted by the third and fourth driving cylinder.

Instead of utilizing two sensors, a detection can also be for both filaments done by a single sensor.

The inventive ringspinning system is adapted that in the case at least one of the sensors detects a breakage of the respective filament, the clamp fixes the second filament at a free end thereof, such that the free end of the second filament is held between the fixing surfaces, and that the knife cuts the first filament at a location where it is delivered from the bobbin.

This actuation may be done in an electronically controlled way, such that the clamp assembly is actuated by an actuator upon detection of a breakage. Alternatively, this actuation may be done mechanically, such that the actuation occurs simply due to the loss of pulling force, which occurs due to breakage of at least one of the filaments or the roving.

In the present case, the ringspinning system is actuated by solenoid actuators. Such a solenoid actuator can also be used to actuate the clamp assembly 8 or only parts of the clamp assembly such as the first and second clamp arms 10, 11, and or the knife element.

The describes actuation is merely an example. Any method which fulfils the aforementioned adaption may be used.

The drafting stage may have a first, second, and third drafting cylinder on which the drafting of the first and second filament together is executed. Also in this case, the terminology first, second, and third drafting cylinder is used because the first drafting cylinder is the most upstream one and the third drafting cylinder is the most downstream one of the first, second, and third drafting cylinders. Alternatively, also more than three or less than three drafting cylinders may be provided.

In particular, the first and second filament are fed together to the first drafting cylinder, where said filaments are drafted together.

The first to third drafting cylinders are arranged in a tilted fashion when viewed from a side along the rotation axis of the bobbin. The tilt of the plane of the first to third drafting cylinders is approximately in the feeding direction of the first and/or second filaments.

Upstream of the drafting stage there may be further provided a guiding device. The guiding device for guiding the first and/or second filament. This guiding device is in particular provided to prevent that the broken ends of the respective filament freely bounce in an uncontrolled manner. Conversely thereto, with the guiding device, the respective broken ends are guided and the risk of contacting and damaging the ring or spindle is reduced.

The guiding device may have at least one opening through which the first and/or second filament is guided before it is or they are fed to the drafting stage.

According to a further development, the guiding device has an arm having a first shank which is slanted with respect to the plane in which the first, second and third drafting cylinders are arranged. This first arm may extend approximately in the direction of the extension of the first and/or second filament.

It may be the case that the first shank is provided with a first and, in some embodiments, a second ring element, which is mounted at a side face of the first shank, which ring element or ring elements define the opening or openings, through which the first and/or second filament is guided before it is or they are fed to the drafting stage. The first shank may have a first ring element. Optionally, there may additionally be a second ring element. The first and/or second ring elements are mounted on the side face of the first shank. Each ring element defines an opening through which the first and/or second filament is guided before they are fed to the drafting stage.

Each of the first and second filament can be guided through a respective one of a first and second ring element alone. Alternatively, the two filaments of the first and second filament can be together guided through one ring. In case there is provided a first and second ring element, for example, both filaments may be guided together to the first and second ring elements, which are arranged in a travelling direction of the filaments one after each other.

In some embodiments, each ring element is mounted perpendicularly to the direction in which a first and/or second filament is fed to the drafting stage. These ring elements provide a guidance for the filament(s) and prevent that the broken end freely bounces. Thereby, the damaging of different parts of the system is prevented.

The arm of the guide element may generally have a V-shape, wherein the ring element is or the ring elements are provided on the first shank. A second shank of the V-shaped arm may be fixed to L-formed securing element protruding in an area between the second and third drafting cylinder and extending with its longer shank of the L-form in the same direction as the second and third drafting cylinder.

Thus, the short shank of the L-form may extend perpendicularly to the plane in which the first, second, and third drafting cylinders are arranged and the V-shaped arm is thus mounted offset to the plane, in which the first, second, and third drafting cylinders are arranged.

In some embodiments, the shank which is fixed to the short side of the L may extend offset and parallel to the surface in which the first, second, and third drafting cylinders are arranged.

The aforementioned configuration provides a good guidance of the first and/or second filament.

The ring element may be constituted by a bent wire element having a space through which the first and/or second filament can be inserted from a side thereof. If such a bent wire element with such a space is provided, it is not necessary to feed the respective filament in a longitudinal direction to the ring.

According to a further embodiment, the inventive ringspinning system has a plurality of ringspinning lines adjacent to each other, wherein each ringspinning line has its own bobbin holder, drafting stage, spindle, sensor, and clamp assembly.

In particular, a first guide element of a first ringspinning line is mounted facing a second guide element having the same constitution as the first guide element, wherein the second guide element is provided on a second ringspinning line directly adjacent to the ringspinning line to which the first guide element belongs.

Moreover, as a further aspect, it is provided a method for stopping the supply of filament to a drafting stage of a ringspinning system. The inventive method comprises the steps detecting a breakage of a first and/or second filament and/or a roving which comes out of the drafting stage, and/or the final ring spun yarn; holding the second filament between the fixing surface of a clamp element, such that a free end of the second filament is held between the fixing surfaces, and cutting with a knife element the first filament at a location where it is delivered from the bobbin, wherein the knife element and the clamp element are arranged adjacent to each other in the region of the bobbin.

Any of the first and/or second filament and/or a roving which comes out of the drafting stage, and/or the final ring spun yarn which is wound up on the spindle may break. If such a breakage is detected, the second filament is held between the fixing surface of a clamp element, and the first filament is cut.

Also, the further configurations of the inventive system described in the previous section may also apply in a method-related way to the inventive method. Therefore, a further discussion thereon is omitted.

The system and the method can be used and executed in a situation, wherein the first filament is an elastic filament and a second filament is a non-elastic filament. However, also more than two core filaments may be used.

The utilization of an elastic filament as first filament and a non-elastic filament as second filament is not essential. It may also be the case that the first filament 2 is a non-elastic filament, while the second filament 3 is an elastic filament. Also, both filaments may be elastic filaments or both filaments may be non-elastic filaments.

BRIEF DESCRIPTION OF THE FIGURES

Further embodiments shall be explained with reference to the Figures, in which.

DETAILED DESCRIPTION

Figure 1:
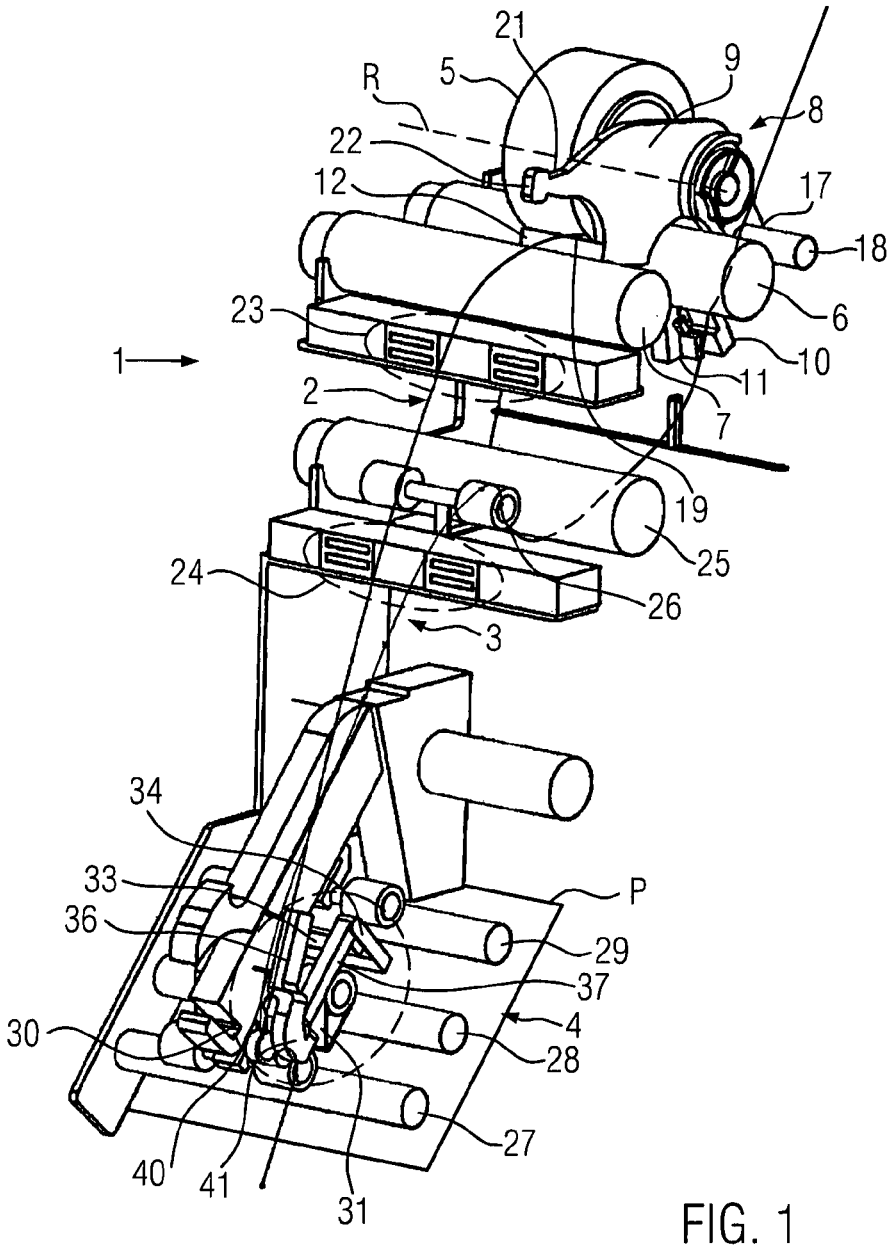
FIG. 1 shows one ringspinning line of an inventive ringspinning system.

FIG. 1 schematically shows a cross-section showing one line of a ringspinning system 1.

The ringspinning system in the present case is a ringspinning system for producing a dual core yarn. Therefore, there is fed a first filament 2 and a second filament 3 to the drafting stage 4. In the drafting stage 4, the first filament 2 and the second filament 3 are drafted. Downstream of the drafting stage 4 the drafted filament which constitutes a roving is ring spun and wound up on a spindle (not shown in the Figure). Although there are presently described two filaments, the disclosure is not delimited to two filaments. There may also be fed three, four, and more than four filaments to the drafting stage 4. Moreover, the final yarn may have a cladding layer made of staple fibers. The first filament 2 in the present case is an elastic filament, while the second filament 3 is a non-elastic filament. The utilization of an elastic filament as first filament and a non-elastic filament as second filament is not essential. It may also be the case that the first filament 2 is a non-elastic filament, while the second filament 3 is an elastic filament. Also, both filaments may be elastic filaments or both filaments may be non-elastic filaments.

As elastic filament, elastane or any other elastic synthetic and non-synthetic filaments can be used. Examples are Spandex. Spandex has superior strength and durability. Spandex also has good resistance to dry heat and oil.

As non-elastic filament, the following filament having no significant elasticity may be used.

Examples are polyester, nylon (nylon 6, nylon 6,6), PBT (Polybutylenterephthalat), viscose. Also any mixture of the foregoing materials can be used.

The filament can also be partially oriented yarn (POY) or highly oriented yarn (HOY).

Partially oriented yarn is produced from the melting and extrusion (melt spinning) of the polyester chip or flake. During the spinning process the filaments are stretched or drawn as much as five times their original size to orient the polymer to meet the desired evenness, strength, shrinkage, and elongation properties. So the term partially oriented yarn refers to multi-filament that is only partially stretched. POY is generally lower tenacity and less uniform than fully oriented yarn (FOY). POY is mainly used in texturizing to make textured yarn and can also be used in draw warping for weaving and warp knitting of fabrics.

The first filament 2 is supplied from a bobbin 5. The bobbin 5 is held in a rotatable manner between a first driving cylinder 6 and a second driving cylinder 7. Only a part of the respective first driving cylinder 6 and second driving cylinder 7 is shown in FIG. 1. The respective driving cylinders 6, 7 extend in a horizontal direction of the system such that the driving cylinders 6, 7 drive different bobbins 5 which are mounted in one row one after each other, wherein each bobbin 5 is assigned to one ringspinning line.

This first and second driving cylinders 6, 7 may be actuated by an actuator (not shown) to provide a driving motion to the bobbin 5. Such a driving motion is generated, as the outer circumferential surface of the bobbin 5 is in contact with the outer circumferential surface of the first and second driving cylinder 6, 7, whereby the bobbin 5 is mounted between the first and second driving cylinder 6, 7.

When the driving cylinders 6, 7 rotate, the first filament 2 is unrolled from the bobbin 5 and supplied to the drafting stage 4. Adjacent to the bobbin 5, there is provided a clamp assembly 8.

The clamp assembly 8 is constituted by a mounting plate 9, a first clamp arm 10, a second clamp arm 11, as well as an erected portion 12.

Figure 2:
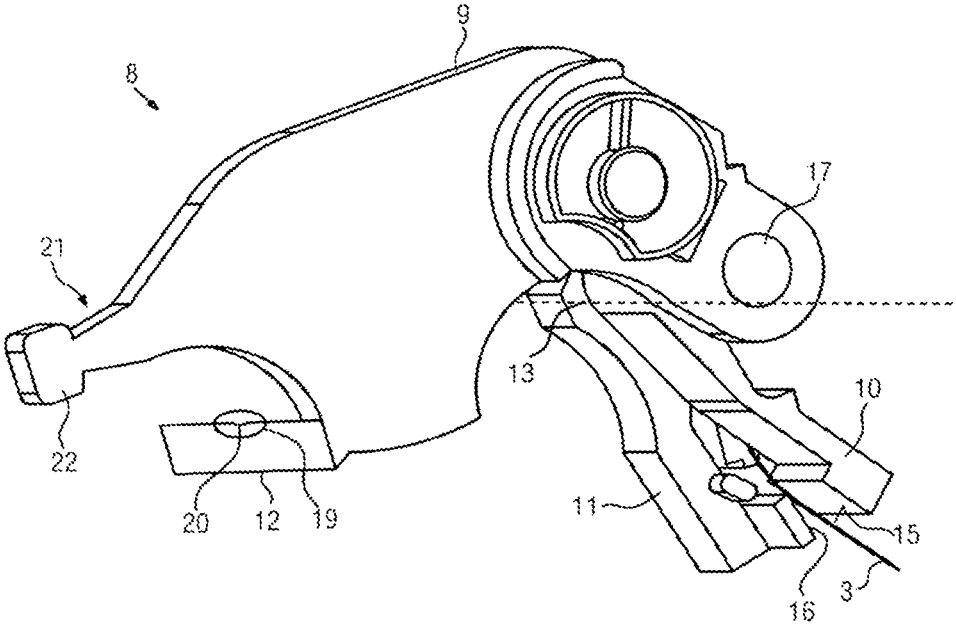
FIG. 2 shows the clamp assembly of the system shown in FIG. 1.

The configuration of the first clamp arm 10, the second clamp arm 11, and the erected portion 12 shall be explained with respect to the clamp assembly 8 shown in FIG. 2 in a magnified form.

The mounting plate 9 has a plate like form and is provided in the specific example between adjacent bobbins 5 of different adjacent ringspinning lines.

In FIG. 1, there is only shown one clamp assembly 8. A plurality of arrangements shown in FIG. 1 may be arranged one after each other in a horizontal direction to provide the ringspinning system.

In the specific case shown in the figures a first clamp arm 10 is rotatably mounted to the mounting plate 9. Further, there is provided a second clamp arm 11, which rotates with respect to the first clamp arm about a rotation axis 13, which is provided offset to a bobbin axis, which is marked in FIG. 1 with reference sign R. Also, the second clamp arm 11 is rotatably mounted to the mounting plate 9. As an alternative, also one of those arms may by a unitary part with the mounting plate 9.

The respective first and second clamp arm 10, 11 has on a distal end portion thereof a first, respectively second, fixing surface 15, 16. Between the respective first and second fixing surface 15, 16, the second filament 3 is clamped in case a breakage is detected.

FIG. 2 schematically shows how the second filament is guided between the first and second fixing surfaces 15, 16.

The mounting plate 9 further has an anchoring hole 17, through which an anchoring rod 18 extends. This anchoring rod 18 (see FIG. 1) extends parallel and offset to the first and second driving cylinders 6, 7 in the horizontal direction of the respective ringspinning lines adjacent to each other. The clamp assembly 8 is mounted via this anchoring hole 17 to the anchoring rod 18.

The erected portion 12 has a knife element 19 at a location where the erected portion 12 faces the outer circumferential surface of the bobbin 5. This knife element 19 may have the form of a blade with a cutting edge. This blade is for example insert molded in the erected portion 12, which is a unitary part of the mounting plate 9.

In the present case, the mounting plate 9, the erected portion 11, and the first and second arms 10, 11 are injection molded elements made from plastic material. Nevertheless, also different materials such as a metal material may be chosen. The erected portion has a recess 20, in which the knife element 19 is provided, which knife element 19 cuts in the case that a breakage is detected the first filament 2 in the region of the bobbin 5.

A nose portion 21 extends from a front side of the mounting plate 9 which nose portion 21 has a broadened portion 22 on which the operator of the system can manually actuate the clamp assembly. The erected portion 12 extends perpendicularly to the plane of the mounting plate 9 and perpendicularly to the extension direction of the first and second clamp arms 6, 7. When a breakage is detected, the second filament 3 is fixed between the first and second fixing surface 15, 16. There may be provided one or more barbs on the fixing surfaces 15, 16 to improve the fixing force applied to the second filament.

The fixation of the second filament 3 is done simultaneously, before, or after the first filament 2 is cut by the knife element 19. This fixing and cutting may be electronically controlled such that the clamp assembly 8 is rotated about the anchoring rod 18 based on a signal of a controlling system which is not shown in the FIGS. When the controlling system gets a signal from at least one sensor (the sensors are described in the following) concerning a breakage, the clamp assembly is actuated, such that the first filament 2 is cut by the knife element 19 and such that the second filament 3 is fixedly held between the fixing surfaces 15, 16 of the first and second clamp arms 10, 11. Such an actuation may also be provided without any computer implemented control simply by a mechanical process which is automatically started due to the fact that the pulling tension acting on the first and/or second filament, when the first and/or second filament is broken, is reduced or completely omitted.

In the present case, the ringspinning system is actuated by solenoid actuators. Such a solenoid actuator can also be used to actuate the clamp assembly 8 or only parts of the clamp assembly such as the first and second clamp arms 10, 11 and or the knife element.

For example, the second filament 3 is pulled through the fixing surfaces 15, 16 by a certain force, in case these fixing surfaces 15, 16 are clamped together. When this specific force is not provided, for example, due to breakage, the fixing surfaces 15, 16, e.g. having the barbs can fix the respective end of the second filament 3. Cutting the first filament 2 with the knife element 19 can also be implemented due to the change in the travelling direction of the first yarn after it is broken. Also further, actuation kinematics for the fixation and cutting are possible.

In the present case, there are provided two sensor elements, namely a first sensor 23 and a second sensor 24. The first sensor 23 senses the breakage of the first filament 2. For this sensor 23, any suitable sensor may be used. The first sensor having reference sign 23 is only schematically shown in FIG. 1. The first sensor 23 in the present case is mounted in the vicinity of the second driving cylinder 7.

Moreover, the system in accordance with FIG. 1 comprises a pair of further driving cylinders in the following identified as third and fourth driving cylinder 25, 26. Said driving cylinders 25, 26 pull the second filament 3 and guide the second filament to the drafting stage 4.

In the specific example, the second filament 3 travels along a lower surface of the third driving cylinder 25 into a region where the third and fourth driving cylinder 25, 26 contact each other to an upper surface of the fourth driving cylinder 26 and from there to the drafting stage 4.

The first sensor 23 is provided between the second driving cylinder 7 and the pair of driving cylinders (third and fourth driving cylinders 25, 26) which drive the second filament 3.

The second sensor 24 is mounted in the region of the third and fourth driving cylinders 25, 26 downstream of the third and fourth driving cylinder 25, 26. With the second sensor 24, a breakage of the second filament 3 is detected.

Instead of utilizing two sensors as in the specific example, a detection can also be done for both filaments by a single sensor.

However, the sensors described are not essential for the disclosure. Any sensor configuration and arrangement may be used.

The drafting stage 4 is set up of a first, second and third drafting cylinder 27, 28, 29. The first, second, and third drafting cylinders 27, 28, 29 are arranged in one plane P, which is tilted approximately extending in the feeding direction of the first and second filaments 2, 3.

When viewed from the front side shown in FIG. 1, above, the plane P of the first drafting cylinder, second drafting cylinder, and third drafting cylinder 27, 28, 29 and in a region where the respective first and second filaments 2, 3 are fed to the drafting stage 4, there is provided a so-called guiding device 30. The guiding device is for guiding at least one of the first and/or second filament 2, 3 to the drafting stage 4. In case a breakage is detected, the guiding device 30 further prevents the downstream broken end of the first and/or second filament 2, 3 to freely bounce. Such a bouncing may damage the drafting stage and/or ring or spindle which is provided downstream of the drafting stage 4.

Figure 3:
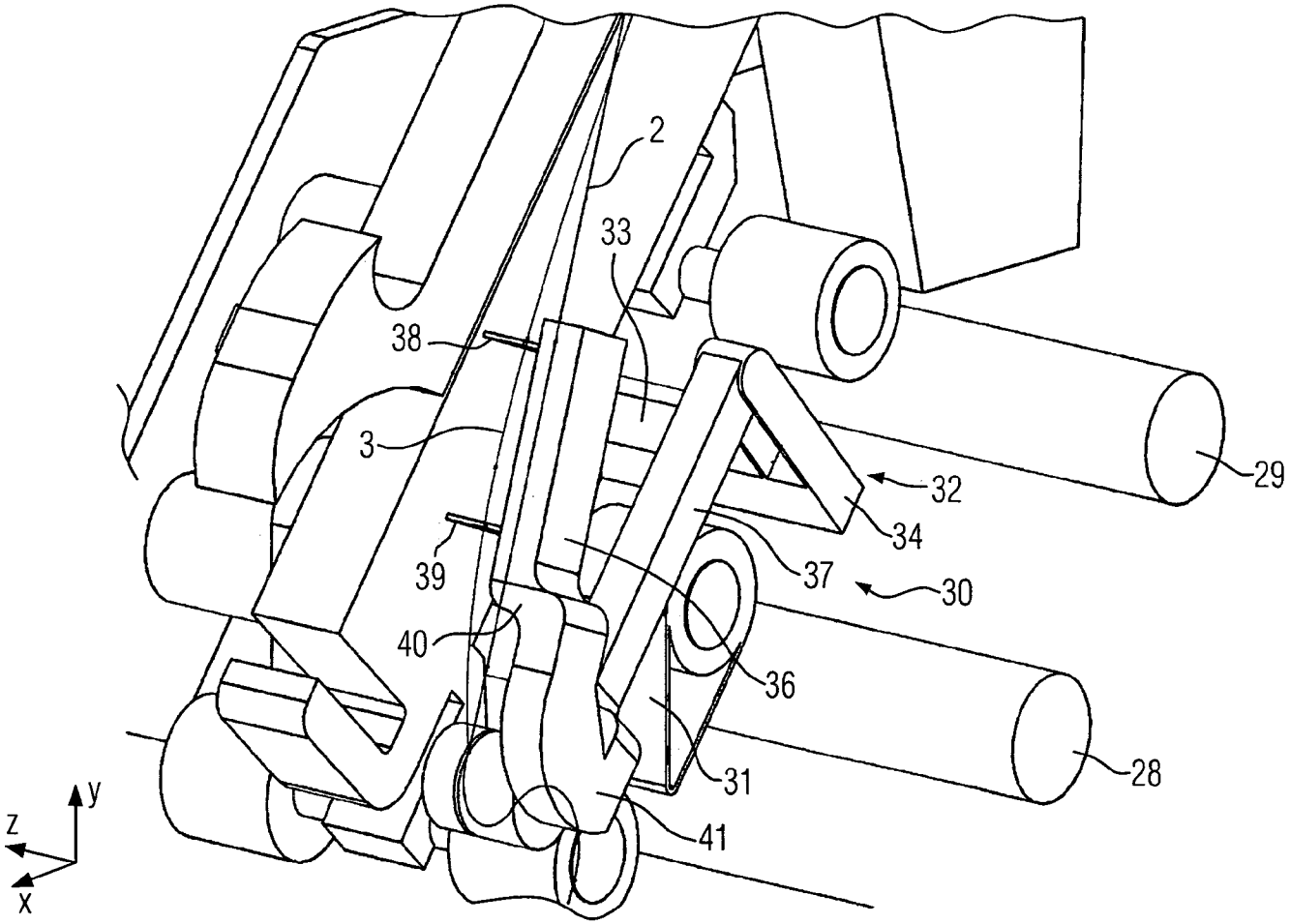
FIG. 3 shows a magnified view on the region of the system shown in FIG. 1, where the guide element is provided.

A magnified view of the guiding device 30 is shown in FIG. 3. This guiding device 30 is constituted by an arm 31 having a general V-shape and an L-formed securing element 32. This L-formed securing element 32 has a longer shank 33 and a shorter shank 34. The longer shank 33 is mounted with a distal end thereof to a plate element extending perpendicularly to the extension direction of the first, second, and third drafting cylinders 27, 28, 29. The longer shank 33 extends in the same direction as and offset from the second and third drafting cylinder 28, 29 in a region between the second and third drafting cylinders 28, 29.

The shorter shank 34 extends perpendicularly to the plane P in which the first, second, and third drafting cylinders 27, 28, 29 are provided. On a distal end of the shorter shank 34, there is mounted a second shank 37 of the V-shaped arm 31. A first shank 36 of the V-shaped arm 31 is tilted in an arcuate angle with respect to the plane P defined by the first, second, and third drafting cylinders 27, 28, 29.

At a side face, which faces an adjacent ringspinning line, the first shank 37 has in the present case two ring elements 38, 39, namely a first ring element 38 and a second ring element 39. The first ring element 38 is provided upstream of the second ring element 39. In the present case, both the first and second filaments 2, 3 are guided through the first and second ring elements 38, 39. It may also be the case that only one of the respective filaments 2, 3 is guided to only one ring element or that only one single ring element is provided, wherein two filaments are fed through this one single ring element. Any configuration with one or more than one ring elements, wherein only one or more than one filaments are guided through the ring elements, may be provided.

The first shank 36 of the V-shaped arm 31 has an offset section 40, on which the ring elements 38, 39 are mounted. Also, the second shank 37 has a respective offset section with which the arm is mounted to the shorter shank 34 of the L-formed securing element 32. Thereby, there is provided a base section 41 in the V-shaped arm 31, which is provided offset from the respective distal ends of the first and second shank 36, 37. Such a configuration is provided in view of space requirements.

Figure 4:
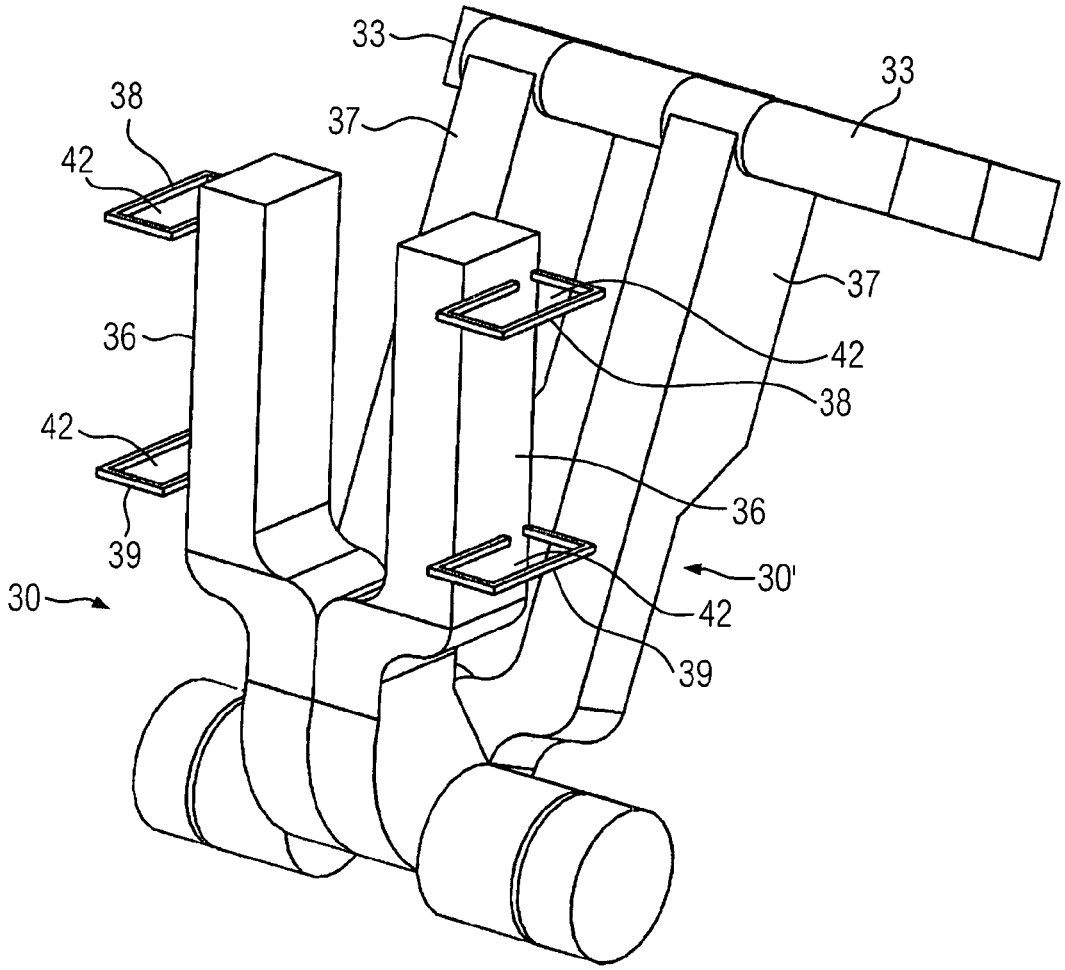
FIG. 4 shows two adjacent guiding elements of adjacent ringspinning lines.

FIG. 4 shows a situation, wherein further to this guide device 30 shown in FIG. 3, a second guide device 30' of an adjacent ringspinning line directly adjacent to the ringspinning line shown in FIG. 1 is provided.

The respective ring elements 38, 39 are provided at surfaces of the respective first shanks 36 of the first and second guiding device 30, 30', which are facing away from each other.

Figure 5:
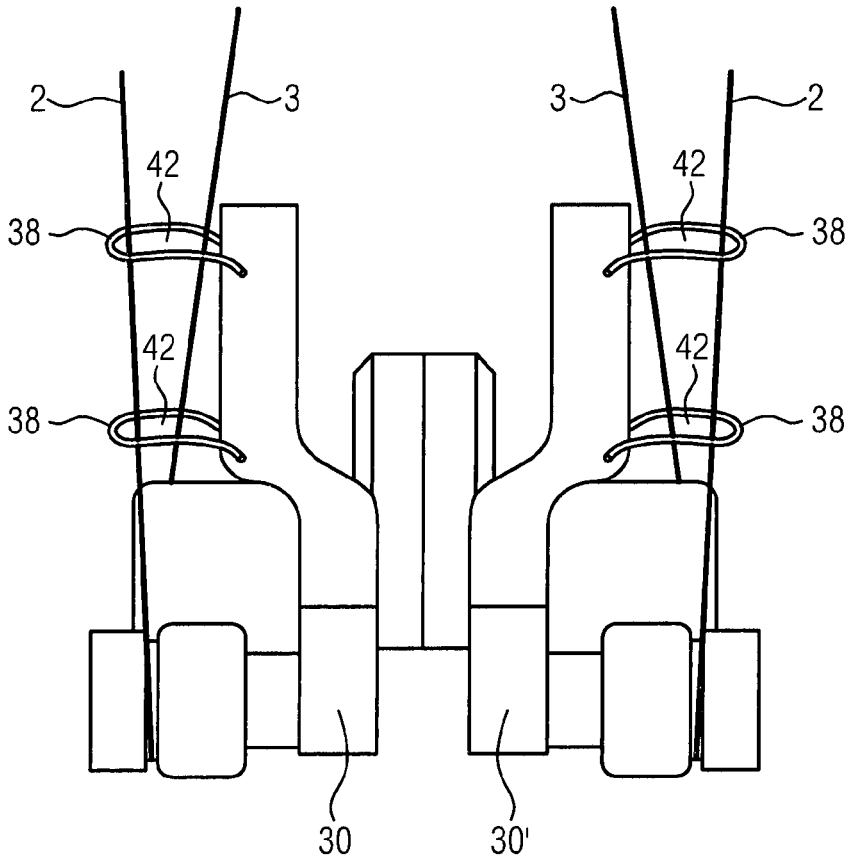
FIG. 5 shows an alternative constitution of adjacent guiding elements of adjacent ringspinning lines.

FIG. 5 shows an alternative configuration of the two guiding devices 30, 30'. The offset configuration of the first shank 36 is similar. However, the arm has not a V-shape, as the V-shaped arm 31 in the other embodiments shown in the figures. Moreover, the ring element in the case of FIG. 5 is made by bent wires having on a side surface thereof an opening 42. Through this opening 42, it is easier to insert the respective first and second filaments 2, 3. Also in the case of FIG. 5, similar as in the example shown in FIG. 4, there are shown two adjacent guiding devices of adjacent ringspinning lines.

REFERENCE SIGN LIST

Ringspinning system 1
First filament 2
Second filament 3
Drafting stage 4
Bobbin 5
First driving cylinder 6
Second driving cylinder 7
Clamp assembly 8
Mouting plate 9
First clamp arm 10
Second clamp arm 11
Erected portion 12
Rotation axis 13
Bobbin axis R
First fixing surface 15
Second fixing surface 16
Anchoring hole 17
Anchoring rod 18
Knife element 19
Recess 20
Nose portion 21
Broadened portion 22
First sensor 23
Second sensor 24
Third driving cylinder 25
Fourth driving cylinder 26
First drafting cylinder 27
Second drafting cylinder 28
Third drafting cylinder 29
Plane P
Guiding device 30, 30'
V-shaped arm 31
L-formed securing element 32
longer shank 33
shorter shank 34
plate element 35
first shank 36
second shank 37
ring element 38, 39
offset section 40
base section 41
opening 42

The invention claimed is:

1. A ringspinning system for producing a yarn, the ringspinning system comprising:

a bobbin holder for holding a bobbin from which a first filament is supplied, a drafting stage for drafting the first filament together with a second filament, which is fed to the drafting stage, and a spindle, which is provided downstream of the drafting stage on which the ring spun yarn is wound up, wherein the ringspinning system further contains:

at least one sensor for detecting a breakage of the first and/or second filament and/or a roving comprising the first and second filaments, which roving comes out of the drafting stage, and a clamp assembly comprising a clamp for fixing the second filament in the case that the sensor detects the breakage, wherein the clamp is provided adjacent the bobbin holder, and wherein the clamp assembly comprises a mounting plate which is placed adjacent to the bobbin, the mounting plate arranged perpendicular to a rotation axis of the bobbin such that the rotation axis of the bobbin extends through the mounting plate, and a first clamp arm and a second clamp arm being rotatable with respect to each other about an axis, each of the first and second clamp arms having a fixing surface to fix the second filament therebetween.

2. The ringspinning system of claim 1, wherein the first clamp arm and the second clamp arm are rotatably mounted on the mounting plate.

3. The ringspinning system of claim 1, wherein the mounting plate has an anchoring hole, with which the clamp assembly is anchored to an anchoring rod provided in the ringspinning system.

4. The ringspinning system of claim 3, wherein the anchoring rod is arranged offset and parallel to the rotation axis of the bobbin.

5. The ringspinning system of claim 1, wherein the mounting plate has a nose portion extending therefrom, which extends perpendicular to an erected portion and perpendicular to the first clamp arm and the second clamp arm.

6. The ringspinning system of claim 1, wherein the ringspinning system further comprises a first driving cylinder and a second driving cylinder with which the bobbin is rotated, while an outer surface of the bobbin on which the first filament is rolled up is rollingly driven by the first and second driving cylinders, while the bobbin is mounted between the first and second driving cylinders.

7. The ringspinning system of claim 1, wherein the at least one sensor comprises a first sensor, with which a breakage of the first filament is detected, and a second sensor, with which a breakage of the second filament is detected.

8. The ringspinning system of claim 7, wherein the second sensor is provided downstream of the first sensor.

9. The ringspinning system of claim 1, wherein the ringspinning system is adapted that in the case at least one sensor detects a breakage of the respective filament, the clamp fixes the second filament at a free end thereof such that the free end of the second filament is held between fixing surfaces, and a knife element cuts the first filament at a location where it is delivered from the bobbin.

10. The ringspinning system of claim 1, wherein the drafting stage includes a first drafting cylinder, a second drafting cylinder and a third drafting cylinder on which the drafting of the first and second filaments together is executed, wherein the second drafting cylinder is provided downstream of the first drafting cylinder, wherein the third drafting cylinder is provided downstream of the second drafting cylinder, and wherein the first, second and third drafting cylinders are arranged in one plane which is tilted towards a feeding direction of the first and second filaments.

11. The ringspinning system of claim 1, wherein the ringspinning system further comprises a guiding device for guiding the first and/or second filament, and wherein the guiding device is mounted upstream of the drafting stage.

12. The ringspinning system of claim 11, wherein the guiding device has at least one opening through which the first and/or second filament is guided before it is or they are fed to the drafting stage.

13. The ringspinning system of claim 12, wherein the guide element has an arm having a first shank which is slanted with respect to the plane in which the first, second and third drafting cylinders are arranged, and the arm extends approximately in the direction of the extension of the first and/or second filament.

14. A ringspinning system for producing a yarn, the ringspinning system comprising:

a bobbin holder for holding a bobbin from which a first filament is supplied, a drafting stage for drafting the first filament together with a second filament, which is fed to the drafting stage, and a spindle, which is provided downstream of the drafting stage on which the ring spun yarn is wound up, wherein the ringspinning system further contains:

at least one sensor for detecting a breakage of the first and/or second filament and/or a roving comprising the first and second filaments, which roving comes out of the drafting stage, and a clamp assembly comprising a clamp for fixing the second filament in the case that the sensor detects the breakage, wherein the clamp is provided adjacent the bobbin holder, wherein a mounting plate has an erected portion on which a knife element is mounted, and wherein the knife element is configured to cut the first filament at a point in a region adjacent to the bobbin, between the bobbin and the drafting stage.

15. The ringspinning system of claim 14, wherein the erected portion is arranged perpendicular to a first clamp arm and a second clamp arm and to the mounting plate.

16. The ringspinning system of claim 15, wherein the erected portion is provided between a first driving cylinder and a second driving cylinder and the first and second clamp arms are provided rearward of the first and second driving cylinders.

17. The ringspinning system of claim 16, wherein the ringspinning system further comprises a pair of driving cylinders, consisting of a third driving cylinder and a fourth driving cylinder, which pair is configured to drive the second filament when it is fed over at least one of said third and fourth driving cylinders, and wherein the pair of driving cylinders, consisting of the third and fourth driving cylinders is located downstream of the first and second driving cylinders.

18. The ringspinning system of claim 17, wherein the second driving cylinder is provided downstream of the first driving cylinder, the third driving cylinder is arranged downstream of the second driving cylinder and the fourth driving cylinder is provided downstream of the third driving cylinder, and wherein a first sensor is provided between the second driving cylinder and the third driving cylinder.

19. The ringspinning system of claim 17, wherein a second sensor is provided upstream of the drafting stage and downstream of the third and fourth driving cylinders.

* * * * *